US009984557B2

(12) United States Patent
Nalukurthy et al.

(10) Patent No.: US 9,984,557 B2
(45) Date of Patent: May 29, 2018

(54) SYSTEMS AND METHODS OF INCREASING THE EFFICIENCY AND ACCURACY OF A WALK TEST IN A FIRE ALARM SYSTEM

(71) Applicant: Honeywell International Inc., Morristown, NJ (US)

(72) Inventors: RajeshBabu Nalukurthy, Bangalore (IN); Aatish Sethi, Bangalore (IN); Balamurugan Venkatesh, Hosur (IN); Mahadevan Somasundram Balakrishnan, Chennai (IN); Devanatha Reddy Sareddy, Anantapur (IN); Monica Ravi, Bangalore (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days. days.

(21) Appl. No.: 15/079,928

(22) Filed: Mar. 24, 2016

(65) Prior Publication Data

US 2017/0278381 A1 Sep. 28, 2017

(51) Int. Cl.

| | |
|---|---|
| ***G08B 1/00*** | (2006.01) |
| ***G08B 29/14*** | (2006.01) |
| ***G08B 29/18*** | (2006.01) |

(52) U.S. Cl.

CPC ..... *G08B 29/145* (2013.01); *G08B 29/185* (2013.01)

(58) Field of Classification Search

CPC ..... G08B 29/145
USPC ..... 340/505, 506, 507, 514, 515, 517, 3.1, 340/539.1, 539.11
See application file for complete search history.

(56) References Cited

U.S. PATENT DOCUMENTS

| | | | | |
|---|---|---|---|---|
| 6,313,744 | B1 | 11/2001 | Capowski et al. | |
| 2004/0119585 | A1 | 6/2004 | Farley | |
| 2005/0280527 | A1 | 12/2005 | Fadey | |
| 2009/0184816 | A1 | 7/2009 | Hosey | |
| 2014/0239817 | A1* | 8/2014 | Leinen | H05B 37/02 315/152 |
| 2014/0375449 | A1 | 12/2014 | Piccolo, III et al. | |
| 2015/0097664 | A1 | 4/2015 | Breed et al. | |

OTHER PUBLICATIONS

Extended European search report for corresponding EP patent application 17156136.8, dated Sep. 7, 2017.

* cited by examiner

*Primary Examiner* — Daryl Pope
(74) *Attorney, Agent, or Firm* — Husch Blackwell LLP

(57) ABSTRACT

Systems and methods of increasing the efficiency and accuracy of a walk test in a fire alarm system are provided. Some methods can include receiving one or more walk test result signals from a system in a region, the signals indicative of one or more triggered input devices in the system and one or more activated output devices in the system, identifying one or more output devices in the system configured to be activated responsive to the one or more triggered input devices, comparing the activated output devices to the output devices configured to be activated, and transmitting a signal indicative of results of the comparing. Additionally or alternatively, some methods can include visually displaying or audibly emitting an indication of the results of the comparing.

17 Claims, 1 Drawing Sheet

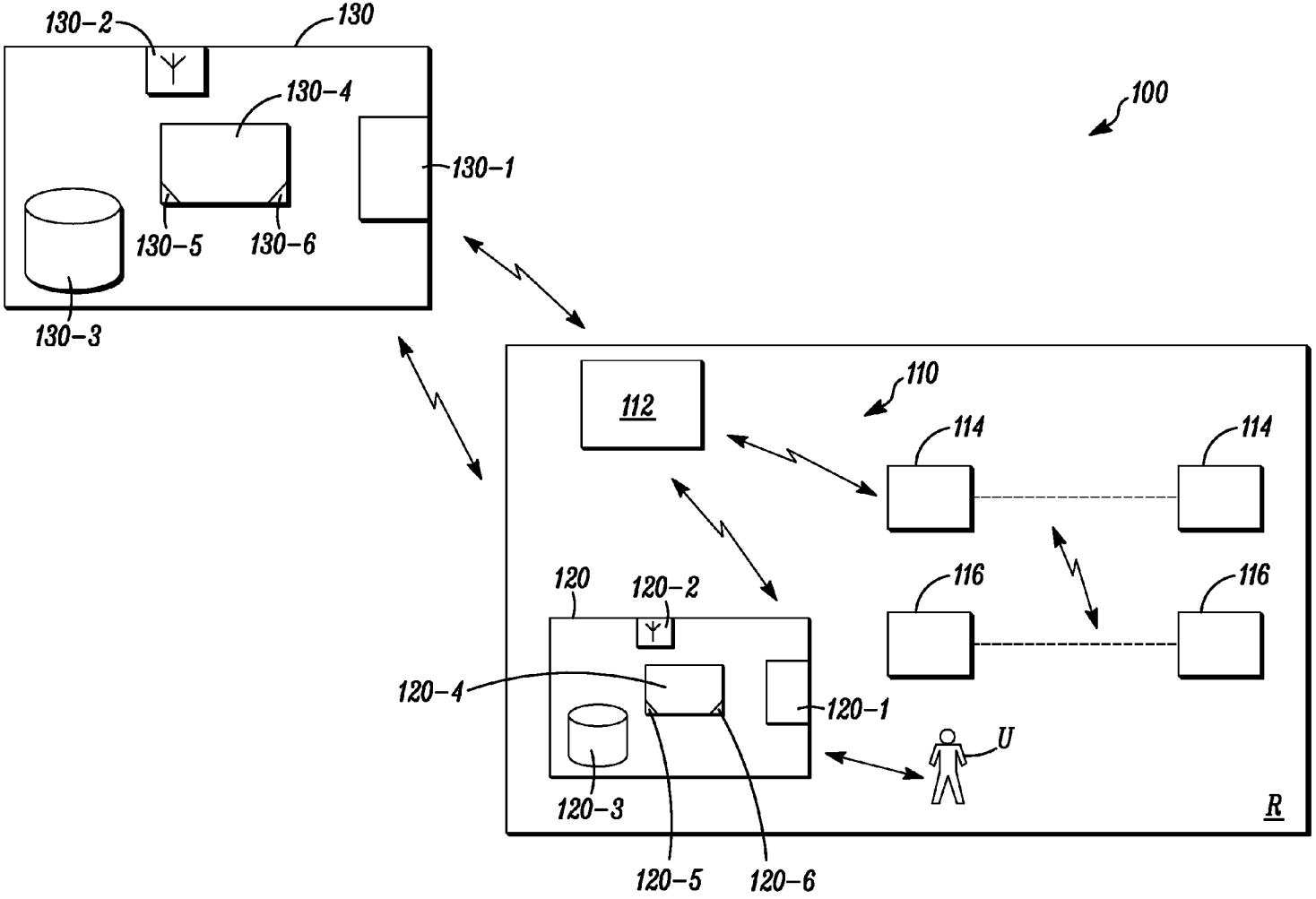
100
110
112
114
114
116
116
R
U
120
120-1
120-2
120-3
120-4
120-5
120-6
130
130-1
130-2
130-3
130-4
130-5
130-6

SYSTEMS AND METHODS OF INCREASING THE EFFICIENCY AND ACCURACY OF A WALK TEST IN A FIRE ALARM SYSTEM

FIELD

The present invention relates generally to walk tests in a fire alarm system. More particularly, the present invention relates to systems and methods of increasing the efficiency and accuracy of a walk test in a fire alarm system.

BACKGROUND

Known walk tests can ensure whether an input or output device is functioning properly. However, known walk tests do not ensure that all output devices are functioning as expected and that an expected number of output devices are activated in accordance with a system configuration.

Furthermore, known walk tests are manual in that they require an onsite technician to manually trigger an input device and manually perform a visual inspection of output devices to determine whether the correct output devices were activated. Adding to the manual nature of known walk tests, the technician must consult a map or blueprint of the site with the location of input and output devices identified and mapped thereon to determine which output devices should be activated when a respective input device is triggered. However, any such consultation is only accurate to the extent that the map or blueprint is current.

The above-described known walk tests can be tedious and time consuming and are prone to human error, especially in systems that include a large number of input and output devices spread out over multiple floors in a large facility. Indeed, known systems and methods require the technician to navigate the facility to each output device for a visual inspection thereof. Furthermore, known systems and methods may also require the technician to be physically present at a control panel of the system, thereby increasing the number of locations that the technician must physically visit.

In view of the above, there is a continuing, ongoing need for improved systems and methods.

BRIEF DESCRIPTION OF THE DRAWINGS

FIG. 1 is a block diagram of a system in accordance with disclosed embodiments.

DETAILED DESCRIPTION

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods of increasing the efficiency and accuracy of a walk test in a fire alarm system. For example, the systems and methods disclosed herein can be used when commissioning or auditing the walk test, when increasing the efficiency of the walk test, or when providing preventive maintenance of the fire alarm system.

In some embodiments, one or more devices of the fire alarm system can be coupled to a cloud server, which can communicate with a handheld device of a user conducting the walk test of the fire alarm system. It is to be understood that the handheld device as disclosed herein can include, but is not limited to a desktop computer, laptop computer, tablet computer, cellular or mobile device, personal digital assistant, and the like. Based on communication signals from the cloud server, the handheld device can graphically display a floor plan of a region in which the fire alarm system is deployed and can graphically display the location of input and output devices of the fire alarm system on the floor plan. In some embodiments, the cloud server can communicate instructions and procedures for conducting the walk test to the handheld device, which can be displayed on the handheld device. As the walk test is being conducted, the cloud server can receive signals from the devices of the fire alarm system and can communicate with the handheld device for graphically displaying, in real time, an indication of triggered input devices and activated output devices on the floor plan displayed on the handheld device.

In some embodiments, the cloud server can compare triggered input devices to a list of input devices that should be triggered during the walk test. When the triggered input devices fail to match the list of input devices that should be triggered, the cloud server can transmit one of the communication signals to the handheld device indicative of the mismatches so that, for example, the user conducting the walk test can trigger any input device that was initially missed.

In some embodiments, the cloud server can include a configuration rules file or cause and effect matrix in a database, and, based on thereon, the cloud server can identify which and how many output devices in the fire alarm system should be activated when respective input devices are triggered. The cloud server can compare which and how many output devices should be activated based on the configuration rules file or the cause and effect matrix to which and how many output devices are activated during the walk test, and based on the results of such a comparison, the cloud server can identify which output devices are not working as expected. That is, the cloud server can compare activated output devices to configured to activate output device. In this manner, systems and methods disclosed herein can automate the process of verifying output devices that are activated, thereby reducing or eliminating errors caused by humans.

It is to be understood that a non-working output device or an output device that is not working as expected can include an output device that is activated responsive to a triggered input device when, according to the configuration rules file or the cause and effect matrix, that output device should not be activated responsive to that triggered input device. Additionally or alternatively, a non-working output device or an output device that is not working as expected can include an output device that is not activated responsive to a triggered input device when, according to the configuration rules file or the cause and effect matrix, that output device should be activated responsive to that triggered input device.

The cloud server can transmit the communication signals to the handheld device, in real time, indicative of any non-working output devices, and responsive to the communication signals, the handheld device can graphically display an indication of which output devices are working properly and which output devices are not working properly. For example, the graphical display on the handheld device can provide an "activated" vs. "should be activated" indication for output devices in the fire alarm system. In some embodiments, the graphical display on the handheld device can graphically localize a non-working output device to assist a user in identifying a cause of that non-working output device, for example, a short in a cable coupled to that non-working output device. Additionally or alternatively, responsive to the communication signals, the handheld display can emit an audible output or display a table or report indicative of whether "activated" output devices match "should be activated" devices and highlighting any mismatches therebetween. When such mismatches are presented to a technician conducting the walk test in real time, he can take appropriate action in an immediate or otherwise timely manner to address non-working output devices.

Although systems and methods disclosed herein are described in connection with the fire alarm system, it is to be understood that systems and methods disclosed herein are not so limited. For example, systems and methods disclosed herein can be used in connection with any ambient condition monitoring or security system that includes input and output devices as would be understood by those of ordinary skill in the art, including, but not limited to gas detection systems and access control systems.

FIG. 1 is a block diagram of a system 100 in accordance with disclosed embodiments. As seen in FIG. 1, the system 100 can include a fire alarm system 110 deployed in a monitored region R, and the fire alarm system 110 can include a control panel 112 in communication with one or more input devices 114 and one or more output devices 116. Each of the input devices 114 and output devices 116 can transmit a wired or wireless signal to the control panel 112 indicative of the respective input device 114 being triggered or the respective output device 116 being activated. Responsive thereto, the control panel 112 can communicate with a remote cloud server device 130 to identify triggered input devices 114 and activated output devices 116 and the respective locations thereof. The cloud server device 130 can separately communicate with a handheld device 120 carried by an onsite technician or other user U in the region R who is conducting a walk test of the fire alarm system 110 in accordance with systems and methods disclosed herein.

Each of the handheld device 120 and the cloud server device 130 can include a user interface device 120-1, 130-1, a transceiver 120-2, 130-2, and a database device 120-3, 130-3, each of which can be in communication with control circuitry 120-4, 130-4, one or more programmable processors 120-5, 130-5, and executable control software 120-6, 130-6 as would be understood by one of ordinary skill in the art. Each of the executable control software 120-6, 130-6 can be stored on a transitory or non-transitory computer readable medium, including, but not limited to local computer memory, RAM, optical storage media, magnetic storage media, flash memory, and the like. In some embodiments, some or all of the control circuitry 120-4, 120-4, programmable processors 120-5, 130-5, and control software 120-6, 130-6 can execute and control the methods described above and herein.

For example, while conducting the walk test of the fire alarm system 110, the user U can manually trigger an input device 114, and responsive thereto, one or more of the output devices 116 can be activated. The triggered input device 114 and the activated output devices 116 can transmit corresponding signals to the control panel 112, which can transmit corresponding walk test result signals to the cloud server device 130, which can receive the signals from the control panel 112 via the transceiver 130-2. Responsive to receiving the walk test result signals from the control panel 112, the control circuitry 130-4, programmable processor 130-5, and control software 130-6 can access a configuration rules file or cause and effect matrix from the database device 130-3 and, based on thereon, execute a simulation of or otherwise determine which output devices 116 should be activated when the triggered input device 114 is triggered. The control circuitry 130-4, programmable processor 130-5, and control software 130-6 can compare the results of the simulation or determination with the received walk test result signals and transmit a signal indicative of the results of the comparison to the handheld device 120 via the transceivers 120-2, 130-2. The control circuitry 120-4, programmable processor 120-5, and control software 120-6 can use the received comparison results signal to graphically or otherwise display on the user interface device 120-1 representations of output devices 116 that were activated during the walk test ("activated" devices) and output devices 116 that were not activated during the walk test, but, based on the results of the simulation or determination and the configuration rules file or the cause and effect matrix, should have been activated during the walk test ("should be activated" devices).

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

receiving one or more walk test result signals from a system in a region, the one or more walk test result signals indicative of one or more triggered input devices in the system and one or more activated first output devices in the system;

responsive to the one or more triggered input devices, identifying one or more second output devices in the system configured to be activated by using a configuration rules file stored in a database device and an identification of the one or more triggered input devices;

comparing the one or more activated first output devices to the one or more second output devices configured to be activated; and transmitting a second signal indicative of results of the comparing.

2. The method of claim 1 further comprising identifying the one or more second output devices configured to be activated based on a cause and effect matrix stored in the database device and the one or more triggered input devices identified therein.

3. The method of claim 1 wherein the configuration rules file is used to execute a simulation of a walk test.

4. The method of claim 1 further comprising identifying one or more non-working third output devices in the system.

5. The method of claim 4 wherein the one or more non-working third output devices include at least one of the one or more activated first output devices that, according to the comparing, should not have been activated.

6. The method of claim 4 wherein the one or more non-working third output devices include at least one of the one or more second output devices configured to be activated that, according to the comparing, should have been activated.

7. The method of claim 1 further comprising receiving the one or more walk test result signals in real time.

8. A method comprising:

receiving one or more walk test signals from a system in a region, the one or more walk test signals indicative of one or more triggered first input devices in the system;

responsive to the one or more triggered first input devices, identifying one or more second input devices in the system configured to be triggered in a walk test by using a configuration rules file stored in a database device and an identification of the one or more triggered first input devices;

comparing the one or more triggered first input devices to the one or more second input devices configured to be triggered; and transmitting a second signal indicative of results of the comparing.

9. The method of claim 8 further comprising receiving the one or more walk test signals in real time.

10. A method comprising:

receiving a first signal indicative of walk test results of a system;

visually displaying or audibly emitting a first indication of incorrect triggers or activations in a respective walk test;

receiving a second signal indicative of non-working output devices in the system; and receiving a third signal indicative of activated output devices in the system that, according to a configuration rules file or a cause and effect matrix stored in a database device, should not have been activated.

11. The method of claim 10 further comprising receiving a fourth signal indicative of non-activated output devices in the system that, according to the configuration rules file or the cause and effect matrix stored in the database device, should have been activated.

12. The method of claim 10 further comprising receiving a fourth signal indicative of non-triggered input devices in the system that, according to a walk test rules file stored in the database device, should have been triggered.

13. The method of claim 10 further comprising receiving the first signal in real time of the respective walk test.

14. The method of claim 10 further comprising:

graphically displaying a floor plan of a region in which the system is installed; and graphically displaying the first indication of the incorrect triggers or activations at respective locations on the floor plan.

15. The method of claim 14 further comprising:

receiving a fourth signal indicative of input devices triggered during the respective walk test or the activated output devices activated during the respective walk test; and graphically displaying a second indication of the input devices triggered during the respective walk test or the activated output devices activated during the respective walk test at the respective locations on the floor plan.

16. The method of claim 10 further comprising displaying a table or other text identifying the incorrect triggers or activations.

17. The method of claim 16 further comprising:

receiving a fourth signal indicative of input devices triggered during the respective walk test or the activated output devices activated during the respective walk test; and including a second indication of the input devices triggered during the respective walk test or the activated output devices activated during the respective walk test in the table or the other text.

* * * * *